United States Patent [19]

Phipps

[11] 4,064,571

[45] Dec. 27, 1977

[54] POOL LINER RETAINER

[75] Inventor: Frank T. Phipps, Georgetown, Canada

[73] Assignee: Timerax Holdings Ltd., Georgetown, Canada

[21] Appl. No.: 722,992

[22] Filed: Sept. 13, 1976

[51] Int. Cl.[2] ..... E04H 3/16

[52] U.S. Cl. ..... 4/172.19

[58] Field of Search ..... 4/172, 172.19, 172.21, 4/172.12

[56] References Cited

U.S. PATENT DOCUMENTS

| | | | |
|---|---|---|---|
| 2,914,776 | 12/1959 | Hotz | 4/172 X |
| 3,347,006 | 10/1967 | Fox | 4/172.21 X |
| 3,628,198 | 12/1971 | Katzman | 4/172.21 |
| 3,777,318 | 12/1973 | Stillman | 4/172.21 |
| 3,975,782 | 8/1976 | Lankheet | 4/172.19 X |

*Primary Examiner*—Charles E. Phillips

*Attorney, Agent, or Firm*—Rogers, Bereskin & Parr

[57] ABSTRACT

A swimming pool liner retainer system is shown which includes a holding assembly and a liner bead. The holding assembly is located around the peripheral edge portion of the pool, and the liner bead is formed on the peripheral portion of the swimming pool liner. The holding assembly includes an elongated member defining first and second U-shaped channels. The first channel is adapted to accomodate the liner bead and has a longitudinal extended portion. The second channel is located adjacent to the first channel so that the opening of the second channel faces said extended portion. A sliding insert retractably projects from the second channel and is biased toward said extended portion, so that the insert retracts to allow the liner bead to enter the first channel and then projects toward said extended portion to securely hold the bead in position.

16 Claims, 5 Drawing Figures

POOL LINER RETAINER

This invention relates to a pool liner retainer, and in particular to a holding assembly for a swimming pool liner retainer system.

In the construction of swimming pools, reflecting pools, fountains and other structures where it is desired to hold relatively large amounts of water or other liquids, it has become fairly common practice to use a liner to line the pool and thus make it watertight. The liner is usually made from vinyl material and is formed into the shape of the cavity or tank which is to form the pool. The liner is supported by rigid wall structures having generally flat supporting surfaces, but otherwise the support structures do not have to be watertight as in pools constructed without liners.

In liner type pool construction, it is usually necessary to retain the pool liner along the top peripheral edge portions of the support structure in order to prevent the water or other liquid from getting behind the liner and leaking out of the pool or causing the liner to collapse. Many methods have been used in the past to attach the peripheral edge portions of the pool liner to the adjacent top edge portions of the pool support structure. One of the most common methods is to use a coping having an elongated slot formed therein. A thickened bead is attached to the peripheral edge portion of the liner and is then inserted into this slot. A transverse elongated rib is usually formed along the edge of the slot adjacent to the liner in order to engage the thickened bead and hold it in the slot.

A difficulty with the prior art structures for holding the peripheral edge portions of the liner is that the liner bead can pull out of the slot fairly easily. Apart from the possible leaks that this may cause, it can present particular problems during the construction and initial filling of the pool. If the liner is not positioned fairly accurately during the initial filling of the pool, the liner wall portions may stretch producing considerable force tending to pull the liner edge portions out of the retaining devices. If the liner edge portions do pull out of the retaining devices, it may not be possible to re-insert them without draining and refilling the pool.

Another difficulty with the prior art structures for retaining the edge portions of the liner is related to the thickened bead which is usually attached along the periphery of the liner. It is common to use a relatively rigid plastic material for this bead and to attach the bead to the relatively flexible liner using a high frequency heat seal. The problem with this construction is that the thickened bead portion is generally exposed to sunlight, and since the material used for the bead has less plasticizer in order to provide the required rigidity, the thickened bead portion tends to deteriorate from ultra-violet light faster than the remaining softer vinyl part of the liner. This often results in the development of cracks or splits along the peripheral edge portions of the liner adjacent to the coping.

The pool liner retainer of the present invention tends to hold the peripheral edge portions of the liner securely, while at the same time reducing the tendency for splitting of the edge portions of the liner due to deterioration of the liner material caused by ultra-violet light.

According to one aspect of the invention there is provided a holding assembly for a pool liner retainer system. The holding assembly has an elongated member defining first and second U-shaped channels. The first channel is adapted to accomodate a pool liner bead and has an elongated extended portion. The second channel is located adjacent to the first channel so that the opening of the second channel faces this extended portion. A sliding insert is adapted to be slidably located in the second channel to retractably project from the second channel toward this extended portion. Also, means are provided for biasing the sliding insert toward this extended portion, so that a liner bead located in the first channel is held in position by the projecting sliding insert.

According to another aspect of the invention there is provided a pool liner retainer which includes a bead formed along the peripheral edge portion of the pool liner and an elongated member defining first and second U-shaped channels. The first channel is adapted to accomodate the pool liner bead and has an elongated extended portion. The second channel is located adjacent to the first channel so that the opening of the second channel faces this extended portion. A sliding insert is adapted to be slidably located in the second channel to retractably project from the second channel toward this extended portion. Also, means are provided for biasing the sliding insert toward this extended portion, so that the liner bead may be removably retained in the first channel by the projecting sliding insert.

A preferred embodiment of the invention will now be described, by way of example, with reference to the accompanying drawings, in which.

Figure 1:
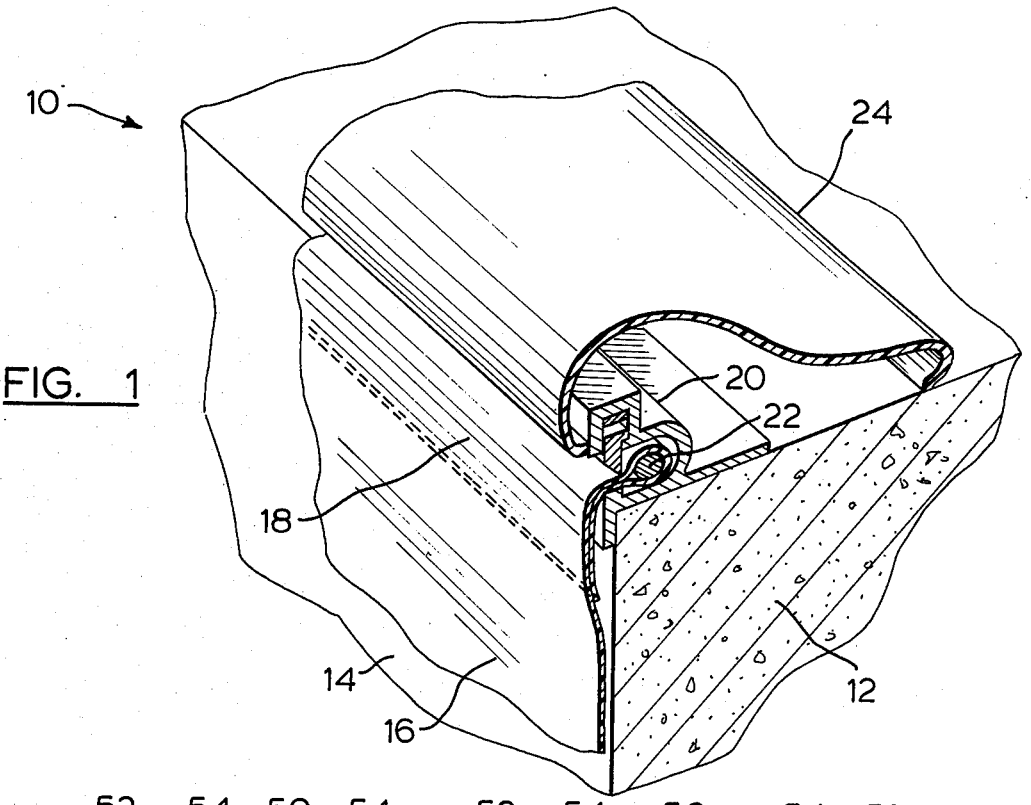
FIG. 1 is a cross-sectional prospective view of the top edge portion of a swimming pool showing the pool liner retainer of the present invention.

Referring firstly to FIG. 1, a pool liner retainer is generally indicated by reference numeral 10 and is shown mounted on the top peripheral edge section 12 of a wall of a swimming pool or the like. Such a swimming pool has an inside wall 14 (and also a bottom which is not shown), which is covered by a swimming pool liner 16. Liner 16 is typically made from pieces of polyvinyl chloride sheet material which are cut and fastened together using high frequency heat seals to conform to the inside shape of the pool. This type of pool construction is conventional and is not considered to be part of the present invention, and therefore will not be described in further detail. However, the top peripheral edge portion 18 of pool liner 16 is part of the present invention and will be described further below.

Pool liner retainer 10 includes an elongated holding assembly 20 and a liner bead 22 which is adapted to be retained in holding assembly 20, thereby securing the top peripheral edge portion 18 of liner 16 along top edge section 12 of the pool. A coping member 24 is generally used in swimming pool construction to cover the liner retainer and eliminate any sharp corners which may cause injury to persons using the pool. Coping member 24 may be any shape or type desired and may be held in place using conventional means. Coping member 24 is also not considered to be part of the present invention and therefore will not be described in further detail. In fact, coping member 24 may be eliminated if desired.

Figure 4:
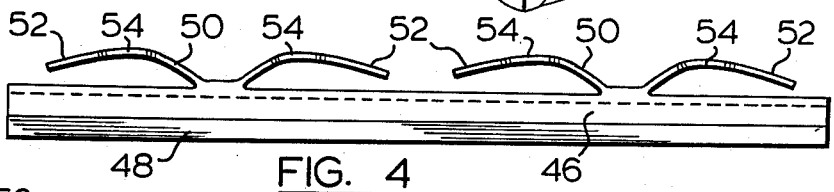
FIG. 4 is a front view of a length of the sliding insert used in the retainer shown in FIG. 1.
Figure 3:
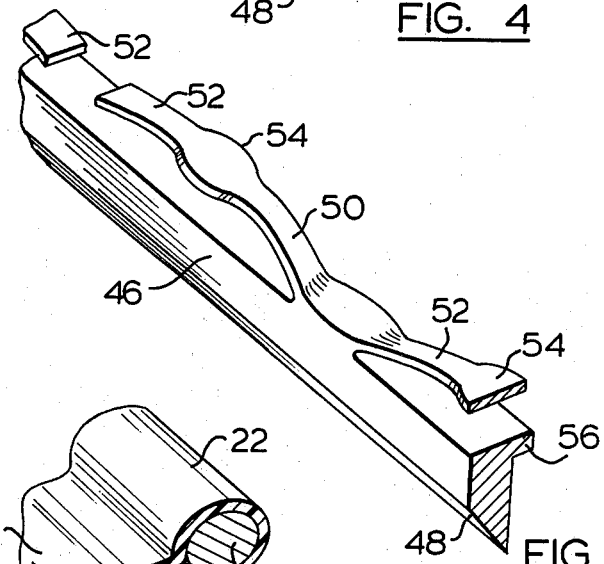
FIG. 3 is an enlarged perspective view of the a sliding insert such as is located in the holding member shown in FIG. 1.
Figure 2:
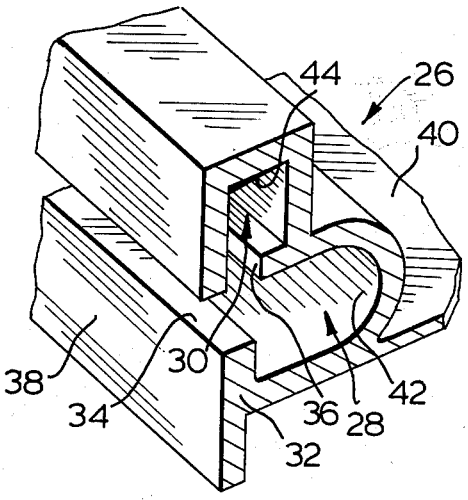
FIG. 2 is an enlarged perspective view of an elongated holding member as shown in FIG. 1.

Referring next to FIGS. 2, 3 and 4, the parts of holding assembly 20 are shown, FIGS. 2 and 3 being enlarged somewhat for the purposes of illustration. Holding assembly 20 includes an elongated member 26 which defines a first generally U-shaped channel 28, and a second generally U-shaped channel 30 located adjacent to first U-shaped channel 28. First channel 28 includes an elongated extended portion 32 which includes an elongated ridge 34 extending transversely toward second channel 30. The second channel 30 is located in a plane perpendicular to the plane of first channel 28, so that the opening of second channel 30 faces extended portion 32. Second channel 30 also includes an elongated transverse rib 36, the purpose which will be described below. Elongated member 26 also includes a vertical downwardly extending flange 38 and a horizontal flange 40, which are used for the location and attachment of elongated member 26 to the top edge section 12. First channel 28 has a rounded inside surface 42 and is adapted to accomodate bead 22. Second channel 30 has a generally flat inside surface 44 and is adapted to accomodate a sliding insert 46 (as shown in FIGS. 3 and 4). Elongated member 26 is typically formed of aluminum, aluminum alloys, or generally rigid polyvinyl chloride. This material is extruded into typical standard lengths of elongated member 26 varying generally from 6 to 9 feet long.

Referring in particular to FIGS. 3 and 4, sliding insert 46 is shown having a wedge-shaped lower portion 48 and a pair of compression springs 50 formed integrally with the body of insert 46. Springs 50 include a pair of wing-like arms 52 having enlargements 54 at the uppermost parts of arms 52. The width of enlargements 54 corresponds to the width of second channel 30. These enlargements are provided to prevent transverse or rocking movement of insert 46 when located inside second channel 30. Insert 46 also has an elongated transverse rib 56 which is adapted to engage rib 36 of second channel 30 to prevent insert 46 from coming out of second channel 30 under the biasing influence of compression springs 50.

Sliding insert 46 is formed of a resilient or elastic generally rigid plastic material. A typical example of such material is a product referred to as DELRIN, which is a trade mark of E.I. Du Pont de, Nemours & Co. of Wilmington, Delaware, United States of America. DELRIN is an acetal resin type plastic which is particularly useful for injection molding, because it is a high flow, high productivity resin which provides short cycles and high yield. DELRIN generally provides high fatigue resistance and consistant spring forces, provided no severe impact is encountered.

Sliding inserts 46 are injection molded approximately 12 inches in lengths. The width and height of insert 46 are respectively approximately three-sixteenths of an inch and five-eighths of an inch, the height dimension including compression springs 50. Wing-like arms 52 are approximately 2½ inches in length in the uncompressed state and are approximately one-sixteenth of an inch in thickness.

Sliding inserts 46 are positioned in holding assembly 20 by compressing springs 50 and sliding the inserts 46 longitudinally through an open end of second channel 30. When released, compression springs 50 bias the wedge-shaped lower portion of insert 46 toward first channel extended portion 32 as shown in FIG. 1. The reason for using relatively short lengths of insert 46, apart from facilitating the extrusion molding process, is that in the event that it is necessary to bend elongated member 26 to conform to curved pool peripheral edges, the short length of sliding inserts 46 will facilitate fairly free vertical movement, without binding inside second channel 30. The total downward spring force provided by the four wing-like arms 52 at maximum compression is approximately 3 pounds. This is sufficient to hold insert 46 in the projecting position as shown in FIG. 1 and thus hold bead 22 in first channel 28.

Figure 5:
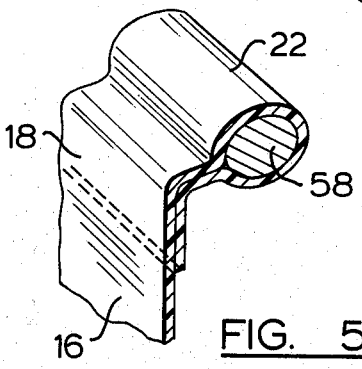
FIG. 5 is an enlarged sectional perspective view of a liner bead as used in the retainer shown in FIG. 1.

Referring next to FIG. 5, bead 22 is formed by wrapping the top peripheral edge portion of pool liner 16 around an elongated core 58 and joining the overlapping portions of the liner using a high frequency heat seal. Core 58 may be made from any relatively incompressible material, such as rope or plastic, and may be rigid or flexible as desired. With this construction, core 58 is not exposed to sunlight and therefore is not subject to deterioration by ultra-violet light.

During the construction of a pool using liner retainer 10, elongated member 26 is first fastened along the top peripheral edge section 12 of the pool walls. Inserts 46 are slid into the ends of each section of elongated member 26 either before or after elongated member 26 is located in position, but in any event while there is still access to an open end of member 26. Bead 22, which has been formed along the top peripheral edge portion of liner 16, is then pressed against the wedge-shaped lower portion 48 of insert 46 causing the insert to retract allowing bead 22 to enter first channel 28. As bead 22 is positioned in first channel 28, insert 46 moves downwardly so that insert 46 and ridge 34 prevent bead 22 from being extracted horizontally from first channel 28. If it is necessary to remove bead 22 from holding assembly 20, a suitable tool can be used to retract insert 46 as the bead is pulled from first channel 28.

Having described a preferred embodiment, it will be appreciated that various modifications may be made to the structure described. For example, compression springs 50 could be made separate members rather than molding them integrally with the body portion of the sliding inserts. A serpentine elongated spring element made of DELRIN or other spring material could be inserted between the insert and the upper inside surface of second channel 30 as the sliding inserts are slid into the end of elongated member 26.

Sliding inserts 46 can be made in other lengths than 12 inches, however this is a convenient length since elongated member 26 is measured by the foot. Shorter lengths of insert 46, such as 3 inch lengths, may be preferable to avoid any binding of the sliding inserts where elongated member 26 must conform to excessively curved pool sides. Also, the transverse rib 56 on the sliding insert and the transverse rib 36 at the opening of second channel 30 could be eliminated if desired. The vertical height of insert 46 could then be increased so that wedge-shaped lower portion 48 rests against ridge 34 to prevent the insert from coming out of second channel 30.

It will be appreciated that the orientation of the first and second channels 28, 30 could be other than horizontal for first channel 28 and vertical for second channel 30. The general cross-sectional shape of elongated member 26 can be modified to suit the particular application or the particular type of coping member 24 being used. Also, the plane of second channel 30 can be other than perpendicular to the plane of first channel 28. For example, the angle between these planes could be less than 90° if necessary.

Liner bead 22 could have some other type or shape of enlarged section. It is even possible to use conventional type liner beads with holding assembly 20, although there still may be the problem of deterioration of the bead caused by ultra-violet light.

Finally, it will be appreciated that the pool liner retainer of the present invention could also be used for securing pool covers rather than pool liners. In a pool cover application, there would be more of a tendency for the cover to be pulled horizontally. The present invention would hold these covers securely, whereas the conventional retainer methods would probably result in the cover being pulled out the retaining element.

I claim:

1. A holding assembly for a pool liner retainer system, comprising:

an elongated member defining first and second U-shaped channels; the first channel being adapted to accomodate a pool liner bead and having an elongated extended portion; the second channel being located adjacent to the first channel so that the opening of the second channel faces said extended portion;

a sliding insert adapted to be slidably located in the second channel to retractably project from the second channel toward said extended portion and said insert having a lower portion defining means whereby upon engagement of said means by a liner bead said insert retracts into said second channel; and means for biasing the sliding insert toward said extended portion, so that a liner bead located in the first channel is held in position by the projecting sliding insert.

2. A holding assembly for a pool liner retainer system as claimed in claim 1, wherein said extended portion includes an elongated ridge extending transversely thereof toward the second channel.

3. A holding assembly for a pool liner retainer system as claimed in claim 2, wherein the second channel is orientated so that the central plane of the second channel is perpendicular to the central plane of the first channel.

4. A holding assembly for a pool liner retainer system as claimed in claim 3, wherein the bias means is a compression spring located between the inside surface of the second U-shaped channel and the sliding insert.

5. A holding assembly for a pool liner retainer system as claimed in claim 4, wherein the bias means comprises a wing-like compression spring formed integrally with the sliding insert, and wherein the insert is formed of DELRIN.

6. A holding assembly for a pool liner retainer system as claimed in claim 4, wherein the second channel includes an elongated transverse rib, and wherein the insert also includes an elongated transverse rib extending toward said second channel rib and adapted to engage said second channel rib to prevent the insert from coming out of the second channel.

7. A holding assembly for a pool liner retainer system as claimed in claim 4, wherein said means includes a wedge-shaped lower portion located so that a liner bead being pushed against said insert lower portion toward the first channel tends to retract the insert and facilitate entry of the bead into the first channel.

8. A holding assembly for a pool liner retainer system as claimed in claim 2, wherein said insert is one of a plurality of sliding inserts of shorter length than the elongated member, the total length of said plurality of inserts being generally equal to the length of the elongated member.

9. A holding assembly for a pool liner retainer system as claimed in claim 1, wherein the second channel is orientated so that the central plane of the second channel is perpendicular to the central plane of the first channel.

10. A pool liner retainer comprising:

a bead formed along the peripheral edge portion of the pool liner;

an elongated member defining first and second U-shaped channels; the first channel being adapted to accomodate said liner bead and have an elongated extended portion; the second channel being located adjacent to the first channel so that the opening of the second channel faces said extended portion;

a sliding insert adapted to be slidably located in the second channel to retractably project from the second channel toward said extended portion and said insert having a lower portion defining means whereby upon engagement of said means by a liner bead said insert retracts into said second channel; and means for biasing the sliding insert toward said extended portion, so that said liner bead may be removably retained in the first channel by the projecting sliding insert.

11. A holding assembly for a pool liner retainer system as claimed in claim 10, wherein the liner bead includes an elongated core member, and wherein the peripheral edge portion of the liner is wrapped around the core member and attached to the adjacent liner portion to hold the core member in place and form said bead.

12. A holding assembly for a pool liner retainer system as claimed in claim 11, wherein said extended portion includes an elongated ridge extending transversely thereof toward the second channel.

13. A holding assembly for a pool liner retainer system as claimed in claim 12, wherein the second channel is orientated so that the central plane of the second channel is perpendicular to the central plane of the first channel.

14. A holding assembly for a pool liner retainer system as claimed in claim 13, wherein the bias means is a compression spring located between the inside surface of the second U-shaped channel and the sliding insert.

15. A holding assembly for a pool liner retainer system as claimed in claim 14, wherein said means includes a wedge-shaped lower portion located so that a liner bead being pushed against said insert lower portion toward the first channel tends to retract the insert and facilitate entry of the bead into the first channel.

16. A holding assembly for a pool liner retainer system as claimed in claim 15, wherein said insert is one of a plurality of sliding inserts of shorter length than the elongated member, the total length of said plurality of inserts being generally equal to the length of the elongated member.

* * * * *